US005836751A

United States Patent [19]

De Villiers

[11] Patent Number: 5,836,751

[45] Date of Patent: Nov. 17, 1998

[54] RECIPROCATING PISTON PUMP

[75] Inventor: Ian Louis De Villiers, Randburg, South Africa

[73] Assignee: Divwatt (Proprietary) Limited, Randburg, South Africa

[21] Appl. No.: 671,017

[22] Filed: Jun. 19, 1996

[30] Foreign Application Priority Data

Jun. 21, 1995 [ZA] South Africa ..... 95/5119

[51] Int. Cl.[6] ..... F04B 17/00; F04B 17/04

[52] U.S. Cl. ..... 417/413.1; 417/418

[58] Field of Search ..... 417/413.1, 418

[56] References Cited

U.S. PATENT DOCUMENTS

| | | | |
|---|---|---|---|
| 2,392,117 | 1/1946 | Burks | 103/148 |
| 4,856,966 | 8/1989 | Ozawa | 417/214 |
| 5,044,891 | 9/1991 | Ozawa | 417/413.1 |
| 5,380,164 | 1/1995 | Fry et al. | 417/413.1 |
| 5,529,467 | 6/1996 | Rometsch | 417/413.1 |
| 5,551,843 | 9/1996 | Hauser | 417/413.1 |

*Primary Examiner*—Bibhu Mohanty
*Attorney, Agent, or Firm*—Jones, Tullar & Cooper, PC

[57] ABSTRACT

A diaphragm pump including a reciprocating piston engaging at opposite ends a pair of diaphragms which close opposite ends of a cylinder is disclosed. The piston ends engage the respective diaphragms across the entire dimension of the cylinder so that the membranes act as seals between the piston and the cylinder, thereby preventing unequal distortion of the diaphragm and enabling the pump to generate high pressure.

15 Claims, 7 Drawing Sheets

RECIPROCATING PISTON PUMP

BACKGROUND TO THE INVENTION

The present invention relates to liquid pumps.

Various types of pumps are known for pumping a liquid e.g. water from one location to another. One such pump is the Archimedian screw type but this has the disadvantage of requiring a fairly high starting torque and also has a relatively low efficiency. Diaphragm pumps on the other hand in operation generate a pressure differential across the diaphragm causing it to fail. Another known type of pump is the piston pump but this suffers from the disadvantage that impurities in the liquid being pumped tend to cause friction between the seal and the piston leading to a breakdown of the seal.

OBJECTIVE OF THE INVENTION

It is an object of the present invention to provide a novel pump for liquids which does not suffer from these drawbacks yet remains relatively efficient.

SUMMARY OF THE INVENTION

A pump according to the invention includes, a cylinder, a wall member of elastomeric material at either end of the cylinder, a pumping chamber backing onto each elastomeric wall member a valved inlet and a valved outlet to each pumping chamber, a piston within the cylinder, the piston having its ends connected to the elastomeric wall members and means to cause the piston to reciprocate within the cylinder, thereby alternately flexing each elastomeric wall member inwardly to draw liquid into the pumping chamber through the valved inlet and outwardly to pump liquid within the pumping chamber through the valved outlet.

Any suitable means may be used to reciprocate the piston for example a rotatable cam, but in a preferred form of the invention use is made of a crank.

More preferably the crank comprises an eccentric mounted on a rotatable shaft. The eccentric results in the flexing of the elastomeric wall members taking place smoothly thus eliminating sudden violent movements which have a deleterious effect on the life of the elastomeric wall members.

The crank or cam may bear directly on piston ends, but in a preferred form of the invention a wear plate is interposed between the two. The wear plate may be affixed to the piston ends but in preferred embodiment of the invention is rotatably mounted on the piston and the cam or crank is adapted to engage the wear plate off-centre. This off-set relationship of the crank or cam as it impinges on the wear plate imparts a rotational force to the wear plate causing it to rotate resulting in an even circular distribution of wear on the wear plate. The life of the wear plate is thereby greatly enhanced.

In one specific form of this embodiment of the invention, at least one bearing is mounted one the eccentric in a position which is off-set relative to the axis of the piston.

The bearings in which the rotatable shaft is rotatably journalled may be of any suitable kind e.g. ball, needle or roller bearings or a combination thereof.

The pump of the invention has a further advantage in that it lends itself to the use of sealed bearings which eliminates the necessity for lubrication.

BRIEF DESCRIPTION OF THE DRAWINGS

In the accompanying drawings which illustrate by way of example preferred embodiments of the invention.

DETAILED DESCRIPTION OF THE DRAWINGS

Figure 1:
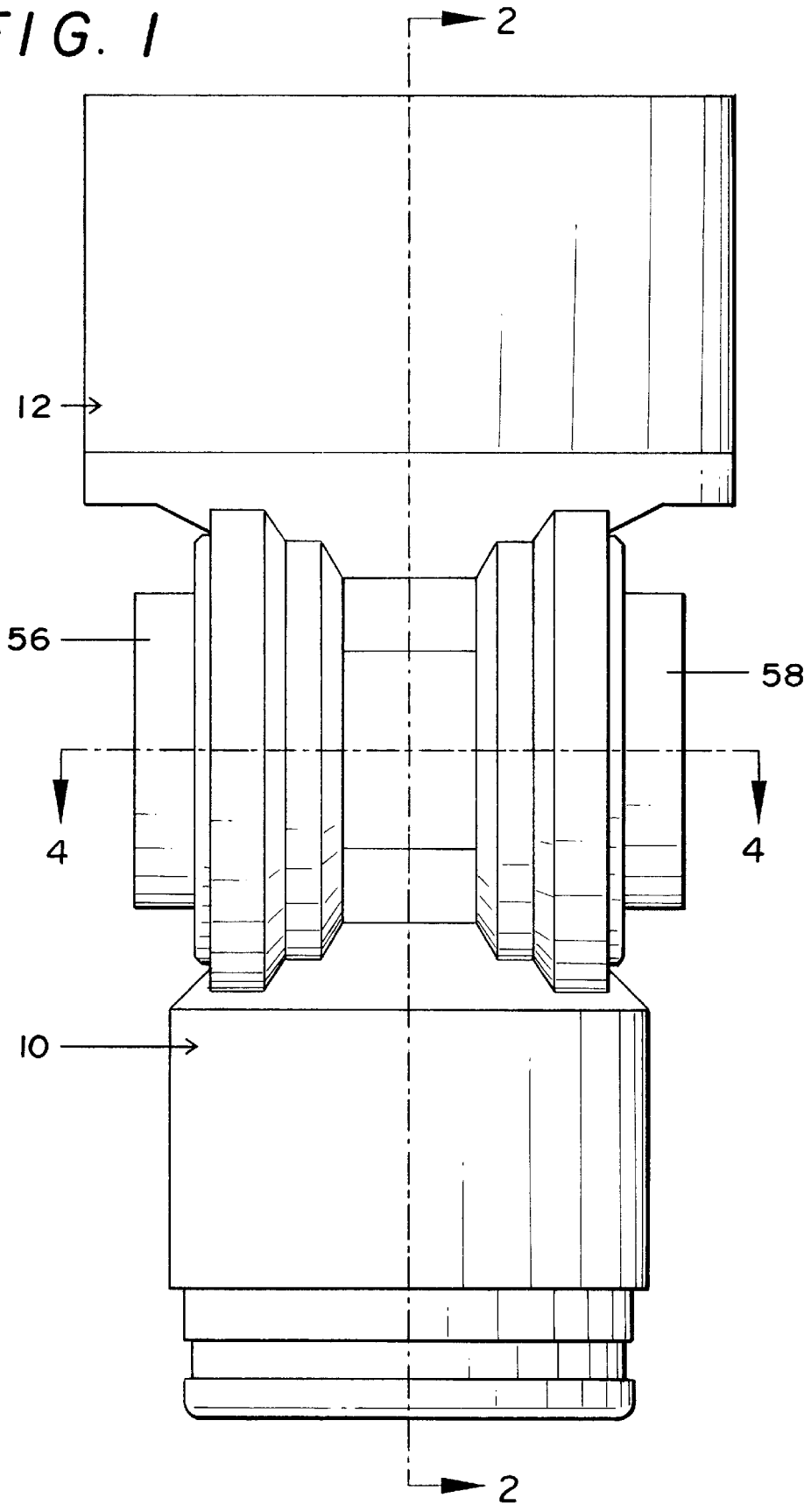
FIG. 1 is a side elevational view of a pump constructed according to the invention.
Figure 2:
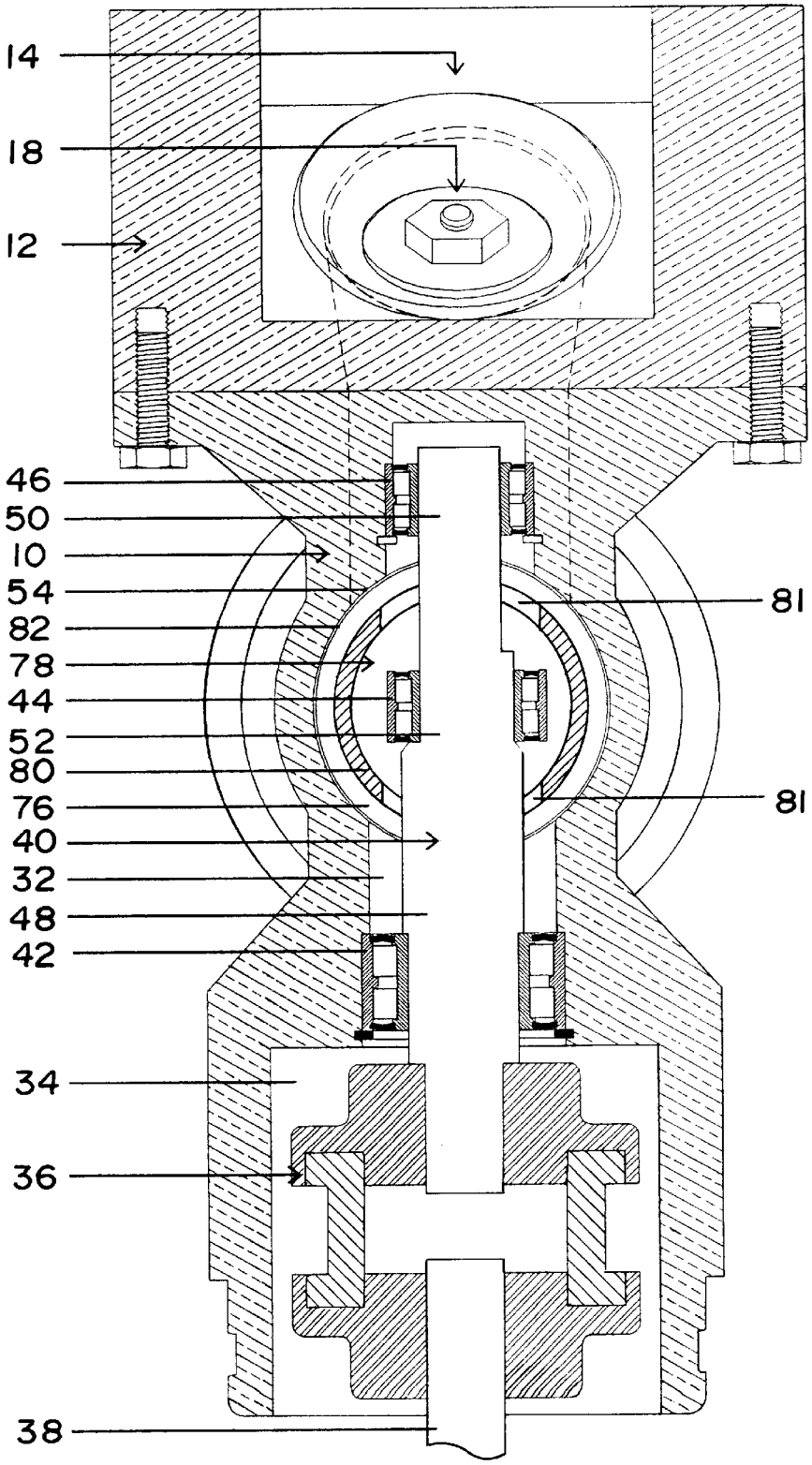
FIG. 2 is a vertical section through the pump along the line 2—2 in FIG. 1
Figure 3:
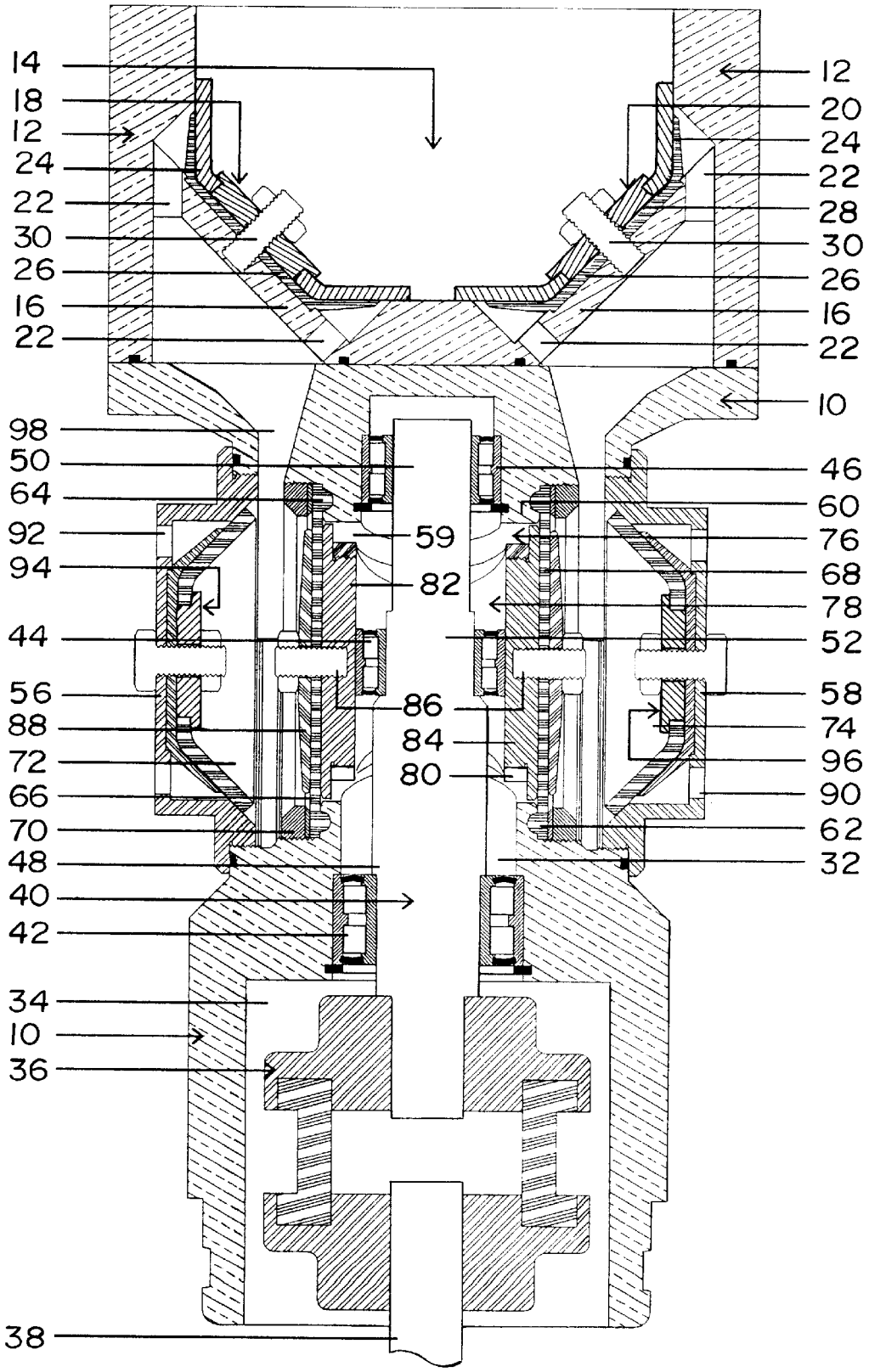
FIG. 3 is a view similar to that of FIG. 2 but taken at right angles to FIG. 2.
Figure 4:
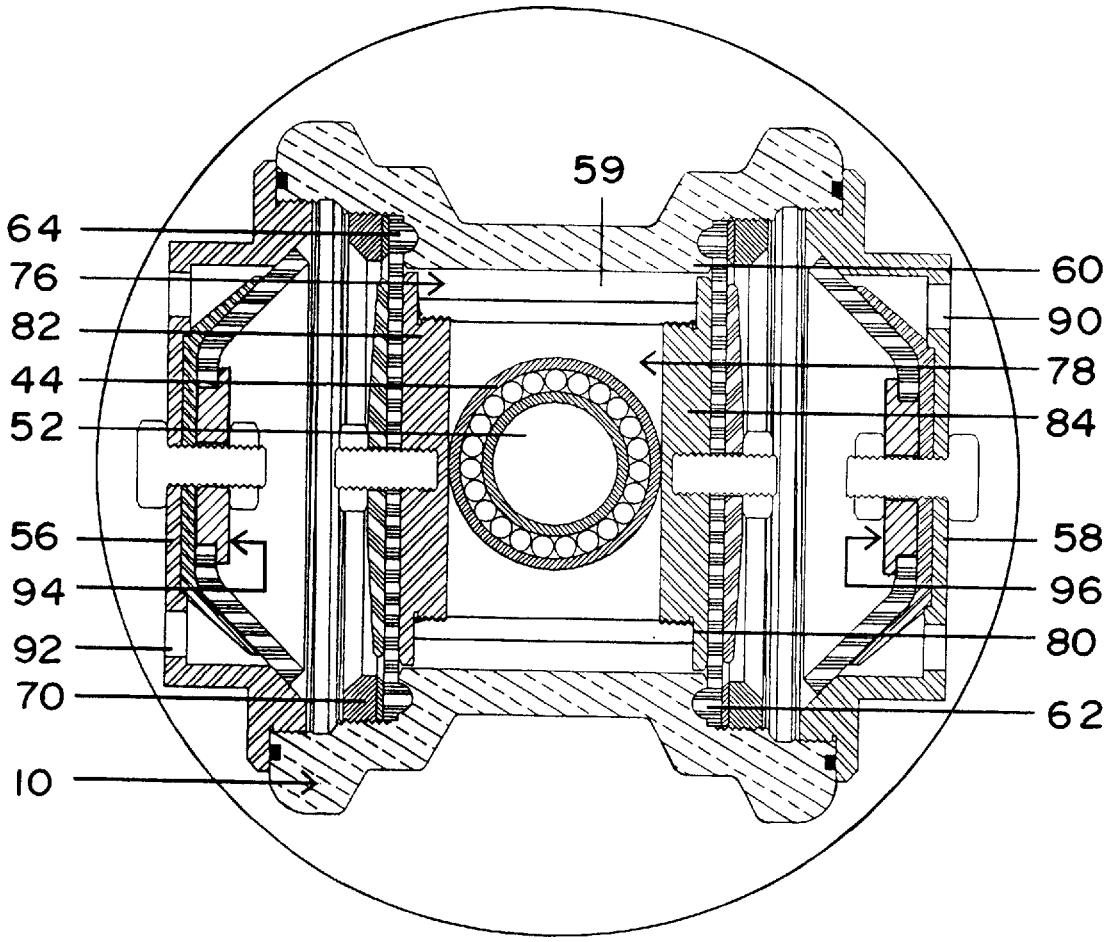
FIG. 4 is a transverse section taken along the line 4—4 in FIG. 1.

Referring to FIGS. 1 to 4 of the drawings the pump of the invention will be seen to include a housing 10 having bolted to its upper end a head section 12. The pump is of generally circular construction.

The head section 12 defines an upwardly open conical dish 14 having located in the inclined wall of its base a series of circularly disposed ports 22. Positioned over the ports 22 are two valves 18 and 20 each including an elastomeric valve member 24, a metal backing plate 26, a washer 28 and a bolt 30 for securing the assembly together and to the wall 16.

The housing 10 is formed with a longitudinal bore 32, which opens at its lower end into a cavity 34, containing a flexible coupling 36 between the drive shaft 38 of a motor (not shown) and a shaft 40. The shaft 40 is rotatably journalled through two sealed roller bearings 42 and 46 mounted on the wall of the bore 32. A further sealed roller bearing 44 is mounted on the shaft 40.

The shaft 40 comprises a larger diameter section 48, an upper smaller diameter section 50 and a central section 52 of intermediate diameter. As will be seen more clearly in FIG. 3, the central section 52 has an axis which is off-set from the longitudinal axis of the shaft 40 and functions as an eccentric. The lower section 48 is formed at its lower end with a shoulder which rests on the upper end of the bearing 42 to locate the shaft 40 within the housing 10.

The housing 10 is furthermore formed with a laterally extending bore 54 which intersects the longitudinal bore 32 and which is closed at either end by end caps 56 and 58 threaded into the bore 54. The bore 54 has a narrower central section 59 which is closed at either end by an elastomeric wall member 66, 68. The wall members 66, 68 are engaged in two annular recesses 62 formed in flanges 60 at either end of the central bore section 59. Retaining rings 70 secure the wall members 66 and 68 in position.

The elastomeric wall members 66 and 68 fulfil a dual purpose. On the one hand they define with the end caps 56 and 58 and the outer sections of the bore 54, two pumping chambers 72 and 74 and on the other hand define with the central bore section 59 a closed ended cylinder 76.

Located within the cylinder 76 is a piston 78 comprised of a sleeve 80 with slots 81, therein to allow for passage of the shaft 40 through the piston 78. To the ends of the sleeve 80 are threaded two piston ends 82 and 84. The ends 82 and 84 are secured to the elastomeric wall members 66 and 68 by bolts 86 passing through backing plates 88. The piston ends 82 and 84 are in engagement with the roller bearing 44 journalled on the eccentric 52.

Provided in each end cap 56, 58 are a series of circularly disposed inlet ports 90 and 92 over which are secured valves 94 and 96. The valves 94 and 96 are of similar construction to the valves 18 and 20.

The principle of operation of the pump will now be explained with reference to FIGS. 5 to 8, of the drawings which are diagrammatic and included for the sake of illustration. Reference numeral a denotes the axis of rotation of the shaft 40 and reference numeral b the longitudinal axis of the shaft portion 52. The eccentricity c of b relative to a has been exaggerated for the sake of clarity and in practice is much smaller.

Figure 5:
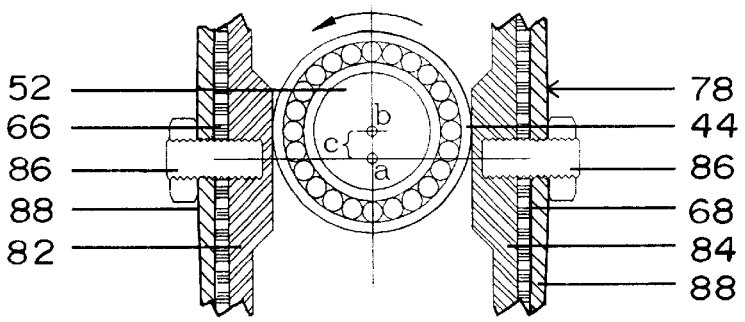
FIG. 5 to 8 are a series of diagrams illustrating the principle of operation of the pump of the invention.
Figure 6:
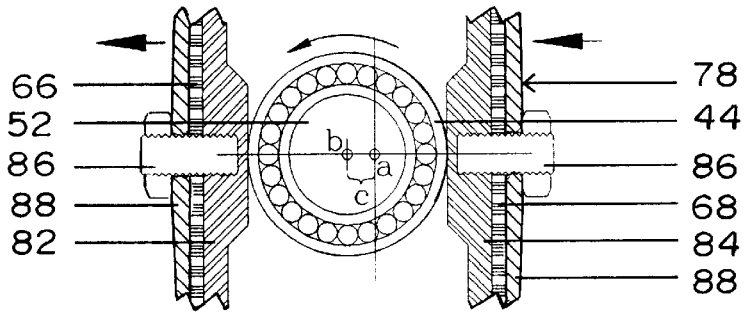
Figure 7:
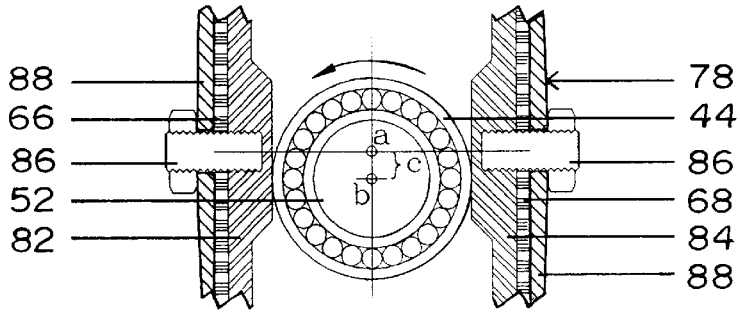
Figure 8:
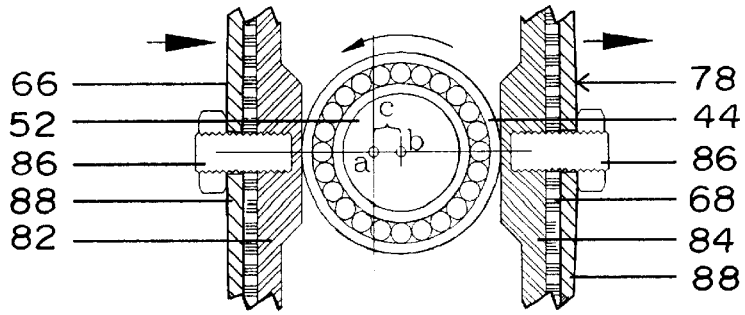

With the shaft 40 in the rotational position shown in FIG. 5, the piston 78 is centralised and the elastomeric wall members 66 and 68 are in an unflexed condition. When the shaft 40 is now rotated anti-clockwise to the FIG. 6 position, the piston 78 is caused to move to the left by the eccentric 52 bearing on the piston end 82 through the bearing 44 thereby flexing the elastomeric wall member 66 outwardly and the elastomeric wall member 68 inwardly. On rotation to the FIG. 7 position the piston 78 is once again centralised. Further rotation to the FIG. 8 position results in the piston 78 moving to the right flexing the elastomeric wall member 68 outwardly and the elastomeric wall member 66 inwardly, just the reverse of the FIG. 5 case. It will be noted that the bearing 44 on the shaft portion 54 remains in contact at all times with both piston ends 82 and 84, resulting in a gradual and smooth flexing of the elastomeric wall members 66 and 68 thus optimising their life.

In operation with the pump submersed in the liquid to be pumped, the motor is started to rotate the shaft 40 flexing the elastomeric wall members 66 and 68 alternately inwardly and outwardly as described above. Inwards flexing of the membrane 66, it will be understood, decreases the pressure in the pumping chamber 72 causing the inlet valve 94 to open and the liquid to be drawn into the pumping chamber 72. When the elastomeric wall member 66 is then flexed outwardly the pressure in the chamber 72 will increase, opening the valve 18 and pumping liquid in the chamber 72 out of the chamber 72 through the passage 98 and the ports 22 into the head section 12. Simultaneously the reverse is occurring in the other pumping chamber 74. The elastomeric wall member 68 is flexing inwardly to draw liquid into the chamber 74 and then outwardly to pump liquid from the chamber 74.

Figure 9:
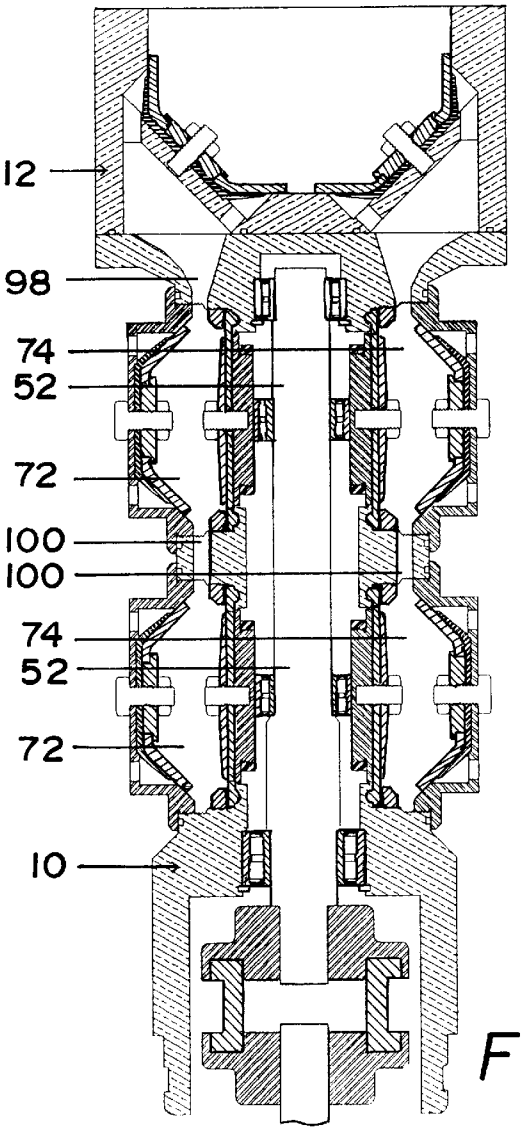
FIG. 9 is a view similar to FIG. 3 of another embodiment of the pump of the invention.

Referring to FIG. 9, there is shown an embodiment with two pump units stacked one on top of the other. During the pumping stroke liquid within the lower chamber 72, say is pumped through port 100 into the upper chamber 72, while liquid in the upper chamber 72 is pumped into the head 12. Simultaneously on the other side of the pump liquid is induced into both the upper and lower chambers 74. The pumping action is therefore doubled.

Figure 10:
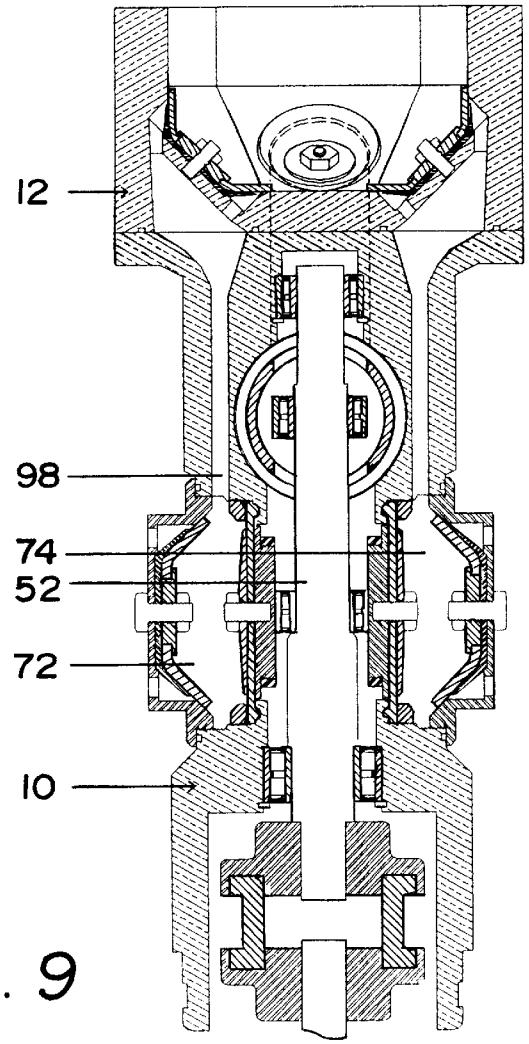
FIG. 10 shows a modification of the pump of FIG. 9.

The FIG. 10 embodiment is similar to that of FIG. 9, except that the upper pump units are disposed at 90 degrees to the lower pump units. This latter configuration results in a more linear power absorption characteristic for the pump.

One of the advantages of the pump of the invention is that it lends itself to the use of sealed bearings eliminating the need for a lubricating system.

Figure 11:
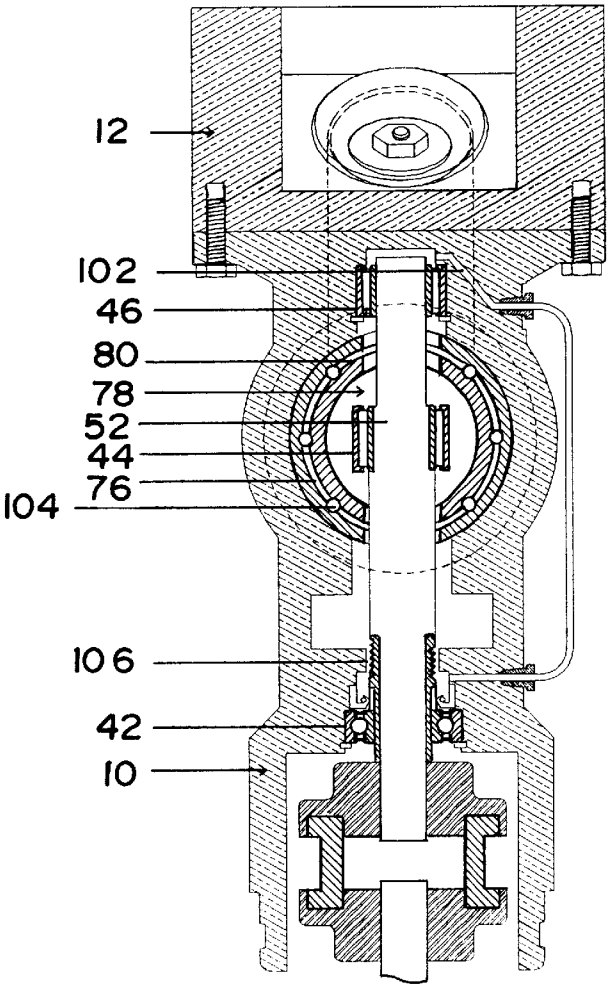
FIG. 11 is a vertical section through another embodiment of the pump of the invention.

However the pump of the invention can also be adapted to operate with un-sealed bearings. FIG. 11 shows such an embodiment. In this case one or more lubrication channels 102 are provided in the wall of the housing 10 to lubricate the bearings. This embodiment also differs from the previous embodiments in that the piston 78 is supported off the cylinder by a linear bearing 104. An oil pump 106 is provided to pump lubricating fluid through the lubrication channel 102 to the bearings.

In another embodiment two or more pump units may be stacked one on top of another in a manner similar to the embodiment of FIG. 9 and 10. However in this case the pump units in the lower row may be disposed at 180 degrees to those in the row above and cross-ported. This configuration results in neutralisation of the vibrational forces in the pump.

Figure 12:
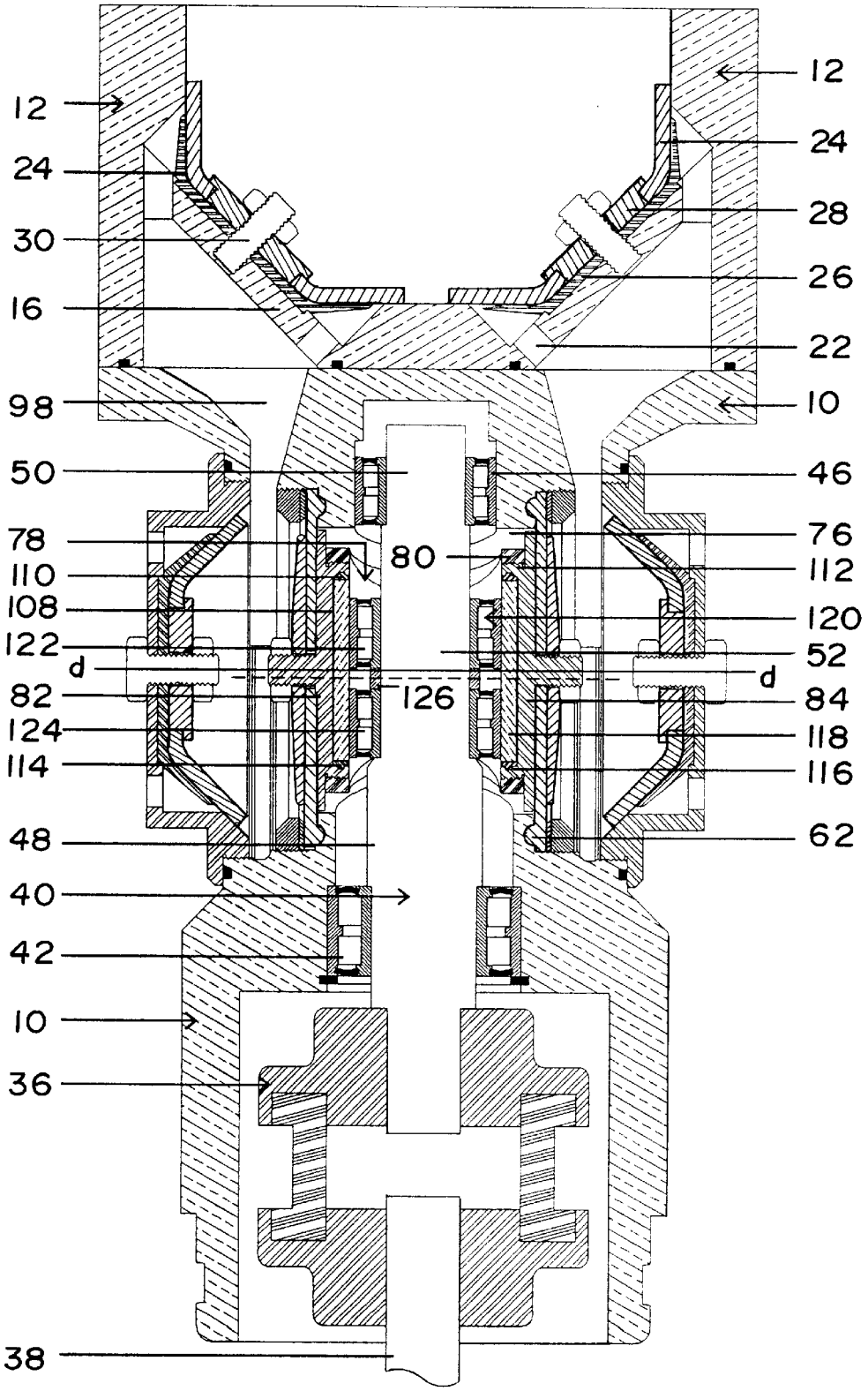
FIG. 12 is a view similar to FIG. 3 of another embodiment of the invention.

In the embodiment shown in FIG. 12, a disc-shaped self lubricating bearing 108, say of teflon, is mounted against the inner face of the piston end 82, 84 and an annular self-lubricating bearing 110, also say of teflon, is mounted within an annular flange 112 on the piston end 82, 84 through a rib 114 on the bearing 110 which engages within a groove 116 in the annular flange 112. Freely rotatably mounted within the bearing 110 against the bearing 108 is a wear plate 118 of a hard wearing material such as for example tool steel. The axis of rotation of the wear plate 118 lies on the axis d—d— of the piston 78. The eccentric on the shaft 40 has mounted thereon a bearing follower set 120 comprised of two bearings 122 and 124 separated by a sleeve 126 positioned between them. Referring to FIG. 12 it will be seen that the axis of the bearing follower set 120, which is indicated by the dotted line, is off-set from the axis of the piston 78 so that on rotation of the shaft 40, the bearing follower set 120 will strike the wear plate 118 off-centre, thereby imparting a rotational movement to the wear plate 118 which results in an even distribution of wear over the plate 118.

I claim:

1. A pump including a cylinder, a wall of elastomeric material closing each end of the cylinder, a pumping chamber backing onto each elastomeric wall, a valved inlet and a valved outlet to each pumping chamber, a piston within the cylinder, the piston having two ends each engaging a corresponding one of the elastomeric walls, and means to cause the piston to reciprocate within the cylinder, thereby alternating flexing the elastomeric wall inwardly to draw liquid into the pumping chamber through the valved inlet and outwardly to pump liquid within the pumping chamber through the valved outlet.

2. A pump as claimed in claim 1 in which the piston reciprocation means includes a rotary cam within the cylinder adapted to bear on each piston end.

3. A pump as claimed in claim 1 in which the piston reciprocation means includes a crank within the cylinder adapted to bear on each piston end.

4. A pump as claimed in claim 3 in which the crank is in the form of an eccentric.

5. A pump as claimed in claim 3 or 4 in which a wear plate is interposed between the crank and each piston end.

6. A pump as claimed in claim 5 in which the wear plate is rotatably mounted within the cylinder and the crank is adapted engage the wear plate off-centre thereby to impart rotation to the plate.

7. A pump as claimed in claim 2 in which a wear plate is interposed between the cam and each piston end, the wear plate is rotatably mounted within the cylinder and the cam is adapted to engage the wear plate off-centre to impart rotation to the plate.

8. A pump including a housing, a longitudinal bore extending upwardly within the housing and being closed at its upper end, a laterally extending bore within the housing intersecting the longitudinal bore and defining a cylinder, a wall of elastomeric material closing each end of the cylinder, a pumping chamber backing onto each elastomeric wall having a valved inlet and valved outlet, a piston within the cylinder engaging the elastomeric walls, a shaft rotatably journalled in the longitudinal bore and extending into the piston, an eccentric mounted on the shaft within the piston, rotation of the shaft causing the piston to reciprocate within the cylinder to alternately flex each elastomeric wall inwardly to draw liquid into the pumping chamber through the valved inlet and outwardly to pump liquid through the valved outlet.

9. A pump including a housing, a longitudinal bore extending upwardly through the housing and being closed at its upper end, a plurality of longitudinally spaced lateral bores intersecting the longitudinal bore and defining a plurality of cylinders, a wall of elastomeric material closing each end of each cylinder, a pumping chamber backing onto each elastomeric wall, a valved inlet to each pumping chamber, an outlet port connecting a first chamber to an inlet to a second chamber, and a valved outlet from the second chamber, a piston within each cylinder connected at each end to a corresponding one of the elastomeric walls, a shaft rotatably journalled in the longitudinal bore and extending through the cylinders, an eccentric on the shaft within each cylinder, rotation of the shaft causing the piston to reciprocate within the cylinders, thereby alternately flexing each elastomeric wall at the end of each cylinder inwardly to draw liquid into adjacent pumping chambers simultaneously through the valved inlets and outwardly to pump liquid from the first chamber into the second chamber and from the second chamber out through the valved outlet.

10. A pump as claimed in claim 9 in which the pumping chambers are disposed vertically directly above each other.

11. A pump as claimed in claim 9 in which vertically adjacent pumping chambers are disposed at right angles to each other.

12. A pump as claimed in any one of claims 8 to 11 in which the shaft and the eccentric are journalled in sealed bearings.

13. A pump as claimed in any one of claims 8 to 11 in which the shaft and the eccentric are journalled in un-sealed bearings.

14. A pump as claimed in any one of claims 8 to 11 in which a wear plate is rotatably mounted against each piston end, and the eccentric is adapted to engage the wear plate off-center to impart rotation to the plate.

15. A pump as claimed in claim 14 in which the eccentric has mounted thereon at least one bearing which is off-set relative to the piston axis.

* * * * *